US010151206B2

(12) United States Patent
Zotz et al.

(10) Patent No.: US 10,151,206 B2
(45) Date of Patent: Dec. 11, 2018

(54) TURBOMACHINE, CIRCULATION STRUCTURE AND METHOD

(71) Applicant: MTU Aero Engines AG, Munich (DE)

(72) Inventors: Georg Zotz, Haimhausen (DE); Giovanni Brignole, Munich (DE); Harsimar Sahota, Garching (DE); Vitalis Mairhanser, Sigmertshausen (DE)

(73) Assignee: MTU Aero Engines AG, Munich (DE)

( * ) Notice: Subject to any disclaimer, the term of this patent is extended or adjusted under 35 U.S.C. 154(b) by 1100 days.

(21) Appl. No.: 14/315,066

(22) Filed: Jun. 25, 2014

(65) Prior Publication Data

US 2015/0003976 A1 Jan. 1, 2015

(30) Foreign Application Priority Data

Jun. 27, 2013 (EP) ..... 13174062

(51) Int. Cl.
*F04D 29/68* (2006.01)
*F01D 9/02* (2006.01)
(Continued)

(52) U.S. Cl.
CPC ..... *F01D 9/02* (2013.01); *F04D 29/526* (2013.01); *F04D 29/563* (2013.01);
(Continued)

(58) Field of Classification Search
CPC .... F04D 29/526; F04D 29/685; F04D 29/684; F04D 29/545; F04D 29/547; F04D 29/681; F01D 11/08; F01D 5/145
See application file for complete search history.

(56) References Cited

U.S. PATENT DOCUMENTS 4,540,335 A * 9/1985 Yamaguchi ..... F01D 7/00 415/129
5,474,417 A * 12/1995 Privett ..... F04D 29/526 415/173.1
(Continued)

FOREIGN PATENT DOCUMENTS

DE 10 2008 010 283 A1 8/2009
EP 1 286 022 A1 2/2003
(Continued)

OTHER PUBLICATIONS

JP 63183204—Translation by Espacenet.*
(Continued)

*Primary Examiner* — Jason Shanske
*Assistant Examiner* — Behnoush Haghighian
(74) *Attorney, Agent, or Firm* — Crowell & Moring LLP

(57) ABSTRACT

A turbomachine having at least one circulation structure is disclosed. The circulation structure has an annular space with baffle elements surrounding a main flow path and is open to the main flow path. A housing of the turbomachine to receive the circulation structure is divided in an axial plane into a front housing region and a rear housing region and the circulation structure is divided into a front structure region and a rear structure region in the axial plane of separation. A circulation structure divided into two parts in the axial direction and a method for the same is also disclosed.

8 Claims, 4 Drawing Sheets

(51) Int. Cl.

| | |
|---|---|
| ***F04D 29/52*** | (2006.01) |
| ***F04D 29/64*** | (2006.01) |
| ***F04D 29/56*** | (2006.01) |
| *F04D 27/02* | (2006.01) |

(52) U.S. Cl.
CPC ..... *F04D 29/644* (2013.01); *F04D 29/685* (2013.01); *F04D 27/0207* (2013.01); *F04D 29/682* (2013.01); *F04D 29/684* (2013.01); *F05D 2230/60* (2013.01); *Y10T 29/4932* (2015.01)

(56) References Cited

U.S. PATENT DOCUMENTS

| | | | | |
|---|---|---|---|---|
| 5,607,284 | A * | 3/1997 | Byrne | F01D 11/08 415/173.4 |
| 6,234,747 | B1 * | 5/2001 | Mielke | F01D 11/08 415/119 |
| 6,585,479 | B2 * | 7/2003 | Torrance | F01D 11/08 415/115 |
| 6,935,833 | B2 * | 8/2005 | Seitz | F01D 5/145 415/58.1 |
| 8,152,445 | B2 * | 4/2012 | Guemmer | F01D 9/04 415/58.5 |
| 8,888,440 | B2 * | 11/2014 | Tomita | F04D 29/4213 415/57.1 |
| 2014/0356144 | A1 * | 12/2014 | Guemmer | F04D 29/161 415/174.1 |
| 2015/0086344 | A1 * | 3/2015 | Guemmer | F04D 29/161 415/174.1 |

FOREIGN PATENT DOCUMENTS

| | | | | |
|---|---|---|---|---|
| EP | 1 478 828 | B1 | 11/2004 | |
| EP | 2 434 165 | A1 | 3/2012 | |
| EP | 3081779 | A1 * | 10/2016 | F01D 11/08 |
| JP | 63183204 | A * | 7/1988 | F04D 29/685 |
| JP | S63-183204 | A | 7/1988 | |

OTHER PUBLICATIONS

EP 3081779—Translation by Espacenet.*
European Search Report dated Nov. 14, 2013, with Statement of Relevancy (Nine (9) pages).

* cited by examiner

TURBOMACHINE, CIRCULATION STRUCTURE AND METHOD

This application claims the priority of European Patent Application No. EP 13174062.3, filed Jun. 27, 2013, the disclosure of which is expressly incorporated by reference herein.

BACKGROUND AND SUMMARY OF THE INVENTION

The invention relates to a turbomachine with at least one circulation structure, a circulation structure for a turbomachine and a method for inserting a circulation structure into a housing of a turbomachine.

Circulation structures and/or recirculation structures for turbomachines, such as gas turbines and their compressors in particular are known as so-called "casing treatments" and "hub treatments." The circulation structures have primarily the task of increasing the aerodynamically stable operating range of the compressor by optimizing the pump limit interval. An optimized pump limit interval permits higher compressor pressures and thus a higher compressor load. The disturbances that are responsible for local compressor stall and ultimately for the pumping of the compressor occur at the housing-side ends of the rotor blades of one or more compressor stages and/or on the hub-side ends of the guide blades that are on the inside radially because the aerodynamic load on the compressor is greatest in these ranges. Flow in the region of the blade ends is stabilized by the circulation structures.

A turbomachine having such a circulation structure is disclosed in DE 10 2008 010 283 A1. The circulation structure is situated in the compressor of the turbomachine of a gas turbine in particular and has an annular space, which is oriented coaxially with the axis of rotation of a rotor of the turbomachine and is opened toward the main flow path. As seen in the main direction of flow of the main flow path, several chambers through which the flow passes in the axial direction are positioned upstream from the annular space. A turbomachine having such an alternative circulation structure is disclosed in EP 1 478 828 B1. This circulation structure also has an annular space that is oriented coaxially with the axis of rotation of a rotor of the turbomachine and is open toward the main flow path, but the annular space has a plurality of baffle elements disposed therein.

The object of the invention is to create a turbomachine having at least one circulation structure, which will facilitate insertion of the circulation structure into a housing of the turbomachine. In addition, another object of the invention is to create a circulation structure that can be inserted easily into a housing of a turbomachine. Furthermore, the object of the invention is to create a method for facilitating insertion of a circulation structure into a housing of a turbomachine.

A turbomachine according to the invention has at least one circulation structure, which has an annular space with baffle elements that extends around a main flow path and is open thereto. According to the invention, a housing of the turbomachine is divided into a front housing region and a rear housing region to receive the circulation structure in an axial plane of separation. Furthermore, in an axial plane of separation, the circulation structure is divided into a front structure region and a rear structure region in an axial plane of separation.

The division of the turbomachine housing to accommodate the circulation structure into at least two housing regions in combination with the division of the circulation structure into at least two structural regions simplifies the production and insertion of the circulation structure. The front structure region and the rear structure region may be formed by individual insertion and/or insert elements, paneling segments and/or liners and the like that are separated in the circumferential direction and can be assembled to form a ring, or ring segments that are closed in the circumferential direction. Likewise, the axial division of the turbomachine housing and the circulation structure allow the front structure region of the circulation structure to be inserted directly into the front housing region of the turbomachine, for example, because alternative milling paths and tools may be used due to the lateral access which is present due to the axial division. To do so, the circulation structure may be enlarged or designed to be more compact, for example. The terms "front" and "rear" here refer to the direction of flow of the main current flowing through the main flow path.

Insertion of the circulation structure can also be simplified if the axial plane of separation of the housing in the installed state is the same as the axial plane of separation of the circulation structure. To prevent the circulation structure from becoming stuck or jammed during assembly, the rear structure region in the assembled state may be set back slightly with respect to the planes of separation, so that after assembly, there is a minimal annular gap between the structure regions.

In one exemplary embodiment, the baffle elements are formed in the front structure region, which is inserted into the front housing region. In this exemplary embodiment, the front structure region is comprised of a plurality of insertion and/or insert segments, which are separated from one another in the circumferential direction and are manufactured separately from the front housing region. Alternatively, the front structure region is a single ring element, which is closed in the circumferential direction and is manufactured separately from the front housing region. The manufacture of the baffle elements can be simplified due to the separate production of the front housing region and the front structure region.

In one alternative exemplary embodiment, the baffle elements are inserted directly into the front housing region. This avoids separate insertion and/or insert segments and/or a separate ring element to form the front structure region, so that fundamentally fewer parts need be assembled. Furthermore, due to the integral design of the front structure region in the front housing region, the weight of the turbomachine and/or its housing is reduced.

The rear structure region is preferably an integral front body section of a paneling element inserted into the rear housing region. The paneling element may consist of a plurality of individual paneling segments divided in the circumferential direction, together forming a closed ring or a single paneling ring. The body section may be a retaining section of the paneling element for fastening the paneling element in or on the rear housing region so that no additional sections need be attached to the paneling element and/or its segments. Production of the baffle elements can be simplified due to the separate production of the rear housing region and the rear structure region. The paneling element preferably has an abradable lining, which extends in the circumferential direction and forms a closed ring, thereby preventing a bypass flow at the tip of the blade from a row of rotor blades opposite the paneling element.

A circulation structure according to the invention for a turbomachine has a structure housing, which is divided into a front structure region and a rear structure region in an axial plane of separation. The at least two-part design of the circulation structure simplifies its fabrication and in particular its integration into a turbomachine housing.

The efficiency of the circulation structure can be improved if it has baffle elements in the front structure region. The baffle elements may be at different lateral spacings from one another and may have different geometries and/or different angular positions. The baffle elements may thus have variable circumferential positions and geometries and/or courses, so that the circulation structure can be adjusted to the respective application case in a targeted manner.

With a method according to the invention for inserting a circulation structure into a housing of a turbomachine, a housing for the turbomachine is made available, having been subdivided into a front housing region and a rear housing region in an axial plane of separation. A front structure region of the circulation structure is then inserted into the front housing region, and a rear structure region of the circulation structure is inserted into the rear housing region. Next the housing regions are joined in the plane of separation.

This method permits a simple insertion and in particular an optimal alignment of the circulation structure due to the axial separation of the turbomachine housing in the region of the circulation structure and the axial separation of the circulation structure. Insertion here means both insertion of structure regions of the circulation structure manufactured separately from the turbomachine housing and an integral design of the structure regions in the turbomachine housing, for example, by means of a milling operation.

Air ducts are formed between the baffle elements in the front structure region, preferably in a single machining operation. Due to this measure the duration of manufacturing of the circulation structure is shortened in comparison with that of known manufacturing times. A finger milling cutter is an example of such a tool. The tool guide is preferably selected so that the flow properties of the baffle elements remain entirely or almost unaffected.

The rear structure region may be machined out, for example. In doing so, the rear structure region is formed integrally and/or directly in the rear housing section, so that fewer parts need be assembled. Furthermore, when the front structure region is formed directly in the front housing region by means of milling operations, for example, then virtually only the housing regions are to be assembled.

To adjust different or reduced transitional radii of the baffle elements from the base of the air ducts, for example, these may be machined separately after milling the air ducts. This can be accomplished, for example, by means of an alternative finger milling cutter with a reduced milling radius in comparison with the finger milling cutter used to form the air ducts.

Preferred exemplary embodiments of the invention are explained in greater detail below on the basis of schematic diagrams.

DETAILED DESCRIPTION OF THE DRAWINGS

Figure 1:
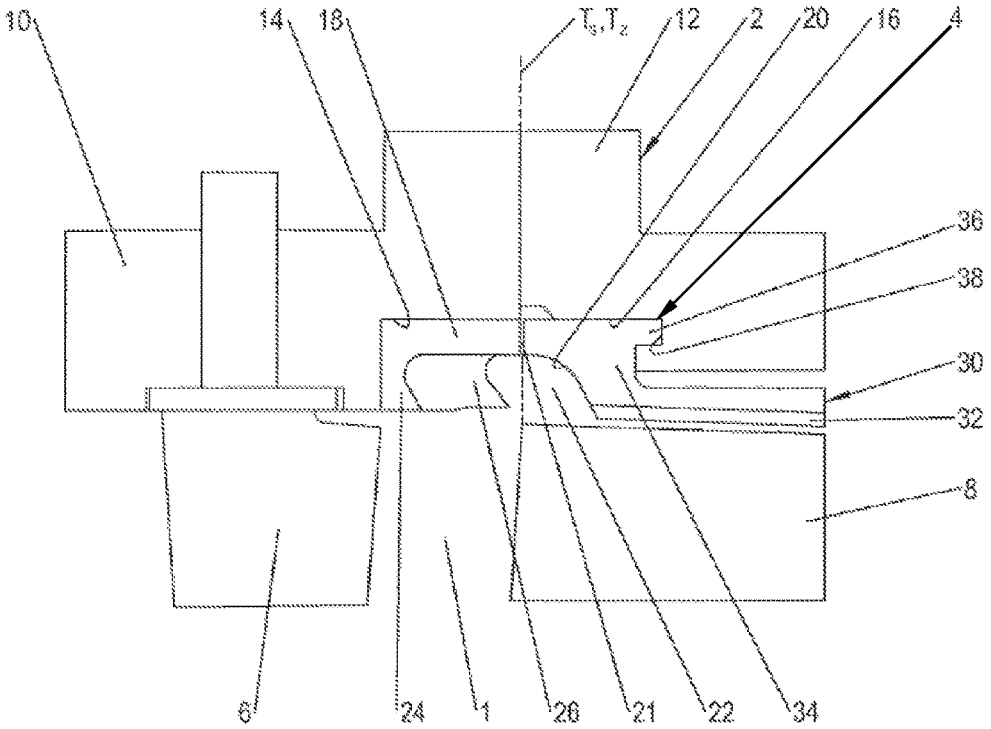
FIG. 1 shows a longitudinal section through a turbomachine in the region of a circulation structure.

FIG. 1 shows a longitudinal section through a main flow path and/or flow channel 1 of a turbomachine in the region of its stator housing 2. In particular, FIG. 1 shows a section through a circulation structure 4 inserted into the stator housing 2. The flow channel 1 has a main flow passing through it from left to right according to the diagram in FIG. 1. The turbomachine is a gas turbine, for example, in particular an aircraft engine. The stator housing 2 forms a divided housing of the turbomachine and is preferably a compressor of the turbomachine.

In the region of the turbomachine shown in FIG. 1, a guide blade ring 6, which is mounted adjustably in the stator housing 2, and a rotor blade row 8, which is assigned to a rotor, are disposed in the flow channel 1. Based on the main direction of flow, the guide blade ring 6 is disposed in front of the rotor blade row 8 and/or the rotor blade row 8 is disposed behind the guide blade ring 6.

The stator housing 2 is subdivided into a front housing region 10 and a rear housing region 12 to accommodate the circulation structure 4 in an axial plane of separation Ts. The housing regions 10, 12 are each provided with a front annular recess 14 and a rear annular recess 16, which are open to the flow channel 1 and to the axial plane of separation Ts. The recesses 14, 16 are disposed opposite one another in the axial direction and/or in the direction of flow, and together they form an approximately U-shaped annular recess.

The circulation structure 4 is subdivided into a front structure region 18 and a rear structure region 20 in an axial plane of separation Tz. The axial plane of separation Tz is positioned so that it is situated on the axial plane of separation Ts of the stator housing 2 in the assembled state shown here. In the assembled state, the planes of separation Ts, Tz are thus identical and/or coincide. To prevent jamming of the circulation structure 4 in assembly and to prevent thermal expansion compensation between the circulation structure 4 and the housing 2, the rear structure region 20 is set back somewhat with respect to the planes of separation Ts, Tz in the assembled state so that, as shown in FIG. 1, a minimum annular gap 21 is formed between the structure regions in the assembled state. The rear structure region 20 may of course also be continued up to the planes of separation Ts, Tz, while the front structure region 18 may be set back with respect to the planes of separation Ts, Tz to form the annular gap 21.

The circulation structure 4 defines an annular space 22, which extends around the flow channel 1 in the radial direction and is open into it. The circulation structure 4 is preferably oriented coaxially with the axis of rotation of the rotor.

In the exemplary embodiment shown here, the front structure region 18 is designed as an insertion and/or insert element 24 that is inserted into the front annular recess 14, a plurality of baffle elements 26 disposed at a distance from one another in the circumferential direction being positioned therein. In the exemplary embodiment shown here, the insertion and/or insert element 24 is a closed ring system in the circumferential direction, but it may also consist of a plurality of segments which are separated from one another in the circumferential direction and form a closed ring in the assembled state. The baffle elements 26 have a profile like a rotor blade and are spaced a distance apart from one another in the circumferential direction by means of air ducts 28 extending approximately in the axial direction (see FIGS. 3 to 7).

The rear structure region 20 is designed to be circumferentially symmetrical and has a deep peripheral groove facing the baffle elements 26 upstream in the exemplary embodiment shown here. The structure region 20 is integrated into a paneling element 30, which is made up of a plurality of closing segments that are separated from one another in the circumferential direction and, in the exemplary embodiment shown here, form a closed ring in the assembled state. Alternatively, the paneling element 30 is a single ring element that is closed in the circumferential direction. To prevent flow around the rotor blade row 8 at the tip of the blade, the paneling element 30 is provided with a peripheral abradable lining 32 on its side which faces the rotor blade row 8.

In particular the rear structure region 20 is formed by an integral front body section 34 of the paneling element 30, which is inserted into the rear ring recess 16 on the stator side. In particular the body section 34 is a retaining section for fastening the paneling element 30 in and/or to the rear housing region 12. The body section and/or retaining section 34 has a retaining ring 36 that is directed downstream and, for fastening the paneling element 30, engages in a form-fitting manner with an annular holding groove 38 that is directed upstream and is inserted into the rear housing region 12.

Figure 2:
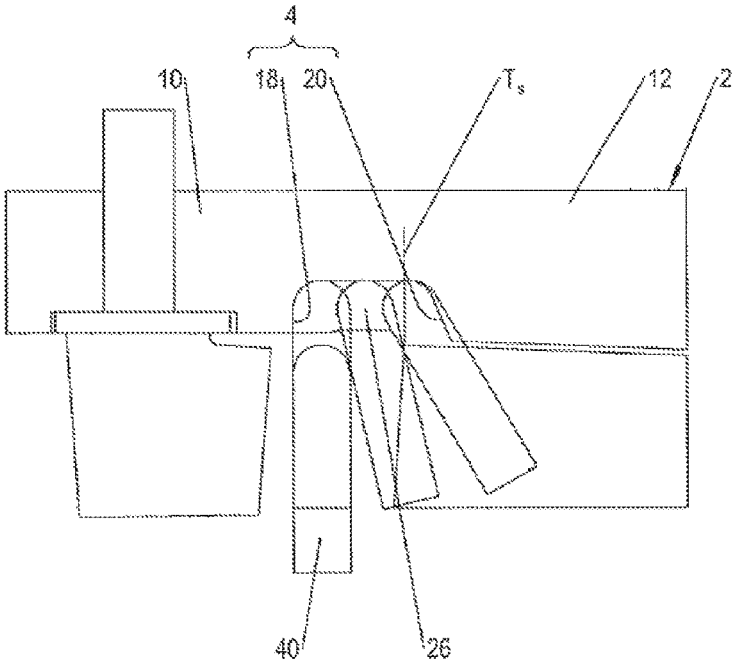
FIG. 2 shows a tool guide for forming an alternative circulation structure.

FIG. 2 shows a tool guide for forming a circulation structure 4 which is inserted integrally into a two-part stator housing 2. The stator housing 2 is divided into two parts, as shown previously in FIG. 1, namely into a front housing region 10 and a rear housing region 12. A front structure region 18 of the circulation structure 4 is disposed in the front housing region 10, and a rear structure region 20 of the circulation structure 4 is disposed in the rear housing region 12.

As shown in FIG. 2, the baffle elements 26 are inserted into the front housing region 10 by means of a milling cutter tool 40, for example, a finger milling cutter. The tool guide is designed so that air ducts 28 formed between the baffle elements 26 (see FIGS. 3 to 5) are each produced in a single machining operation. Accordingly, the finger milling cutter 40 has a milling width that corresponds to a spacing of the baffle elements 26 from one another on the circumferential side.

In this exemplary embodiment, the rear circumferentially symmetrical structure region 20 is also formed by means of the finger milling cutter 40 in the stator housing 2 and in particular in the rear housing region 12. Alternatively, the rear structure region 20 may be pre-turned and/or just turned in the rear housing region 12 before a machining operation by milling, using the finger milling cutter 40 (see FIG. 9).

Figure 3:
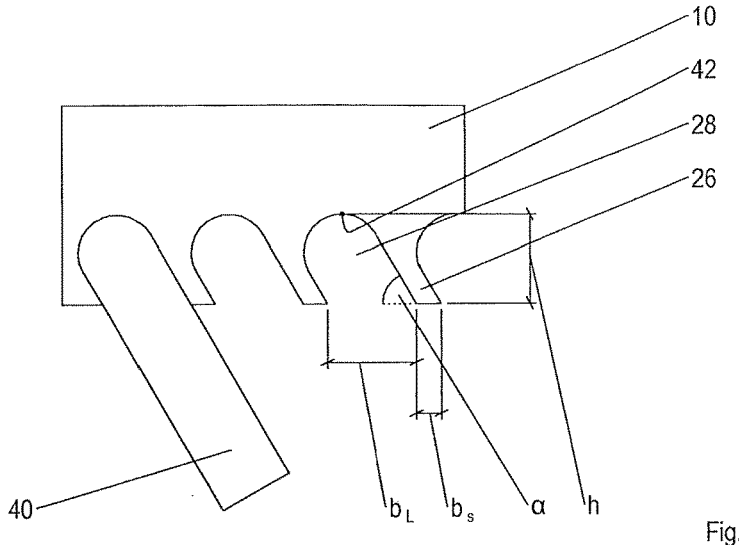
FIGS. 3, 4, and 5 show various designs of baffle elements in the front structure region of the circulation structure.

As shown in FIG. 3, the baffle elements 26 and/or the air ducts 28 formed between the baffle elements 26 may have a uniform circumferential positioning. In particular the air ducts 28 then have a uniform concave basic contour 42, a uniform setting angle $\alpha$ in the circumferential direction, a uniform radial height h and a uniform circumferential-side width $b_L$. The baffle elements 26 have a constant circumferential-side width $b_S$ with a uniform circumferential positioning. The width $b_S$ here corresponds to the width of the finger milling cutter 40.

Figure 4:
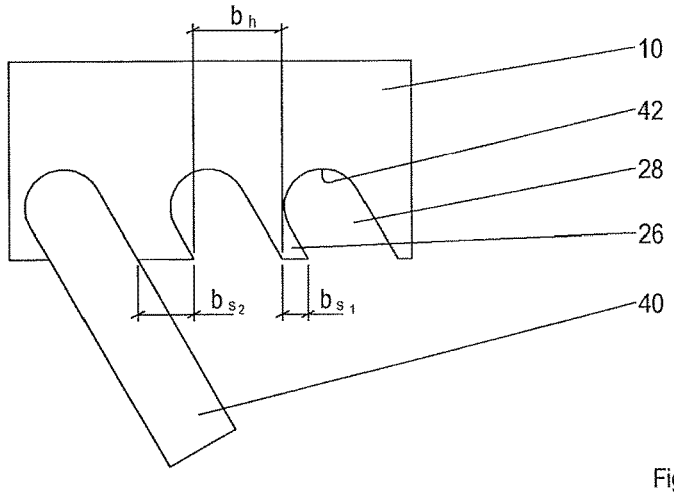

As shown in FIG. 4, the baffle elements 26 may also have a varying width $b_{S1}$, $b_{S2}$, but the air ducts have a uniform width $b_h$, so that both the baffle elements 26 and the air ducts 28 have a variable circumferential positioning.

Figure 5:
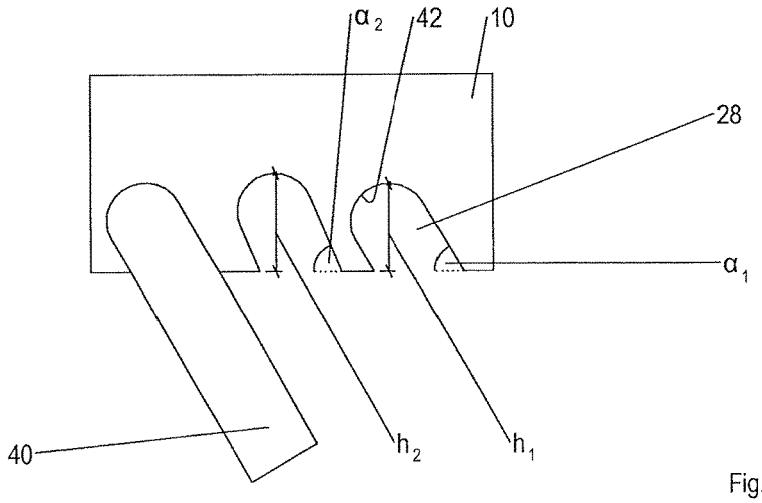

According to the diagram in FIG. 5, the setting angles $\alpha_1$, $\alpha_2$ of the air ducts 28 and/or the radial height $h_1$, $h_2$ of the air ducts 28 may also vary.

With all the specified exemplary embodiments according to FIGS. 2 to 5, it does not matter that for inserting the circulation structure 4 into the stator housing 2, first the stator housing 2 is subdivided into a front housing region 10 and a rear housing region 12 in an axial plane of separation Ts. Then the front structure region 18 of the circulation structure 4 is inserted into the front housing region 10, and the rear structure region 20 of the circulation structure 4 is inserted into the rear housing region 12. Next the front housing region 10 and the rear housing region 12 are joined. The air ducts 28 and thus the baffle elements 26 are preferably each created in a single machining operation.

Figure 6:
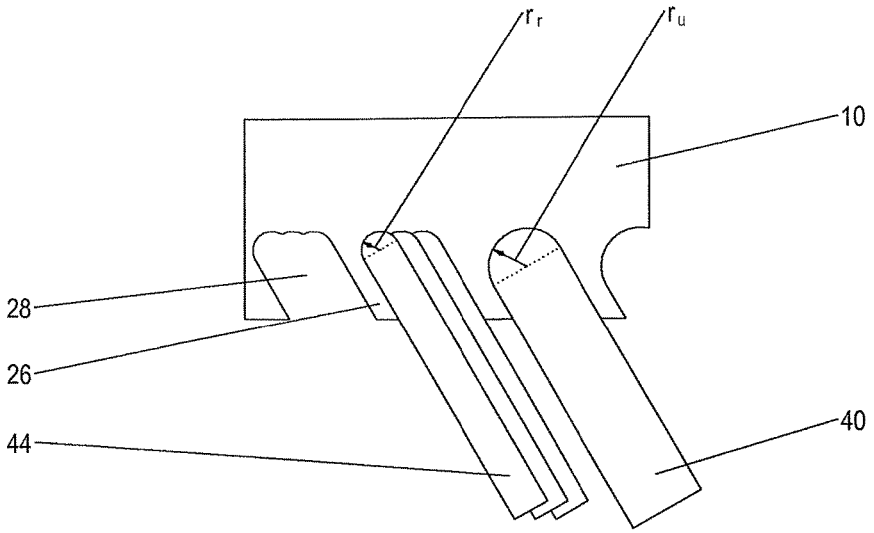
FIGS. 6 and 7 show exemplary tool guides to form the baffle elements with small transitional radii.
Figure 7:
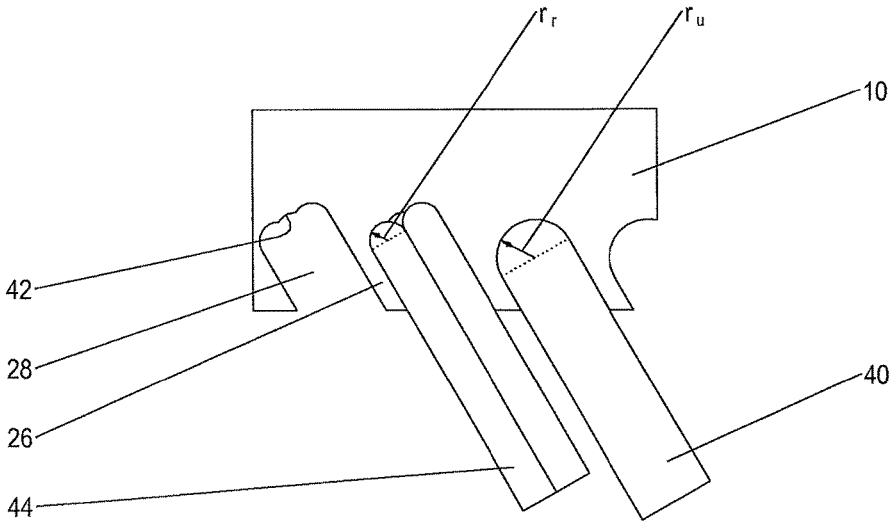

FIGS. 6 and 7 show the design of the baffle elements 26 whose transitional radius $r_r$ has been reworked to the basic contour 42 of the air ducts 28. In the exemplary embodiments according to FIGS. 6 and 7, the transitional radii $r_r$ are reduced in size in comparison with the original transitional radius $r_u$.

The reduced transitional radii $r_r$ are designed preferably by means of alternative finger milling cutters 44, which have a reduced milling radius in comparison with the original finger milling cutter 40 and have a reduced milling width. As shown in FIG. 6, the reduced milling cutter 44 may be guided in overlapping paths or, as shown in FIG. 7, may be guided in adjacent paths. Furthermore, as shown in FIG. 6, the reduced milling cutter 44 may be driven between the baffle elements 26 to different depths, so that the basic contour 42 per se is altered, in addition to a reduction in the transitional radii $r_r$. As shown in FIG. 6 as an example, a more or less planar basic contour 42 can thus be created, extending almost tangentially to the circumferential direction. A quasi-planar basic structure 42, which extends obliquely to the circumferential direction, may thus also be created, as shown in FIG. 7 as an example.

Figure 8:
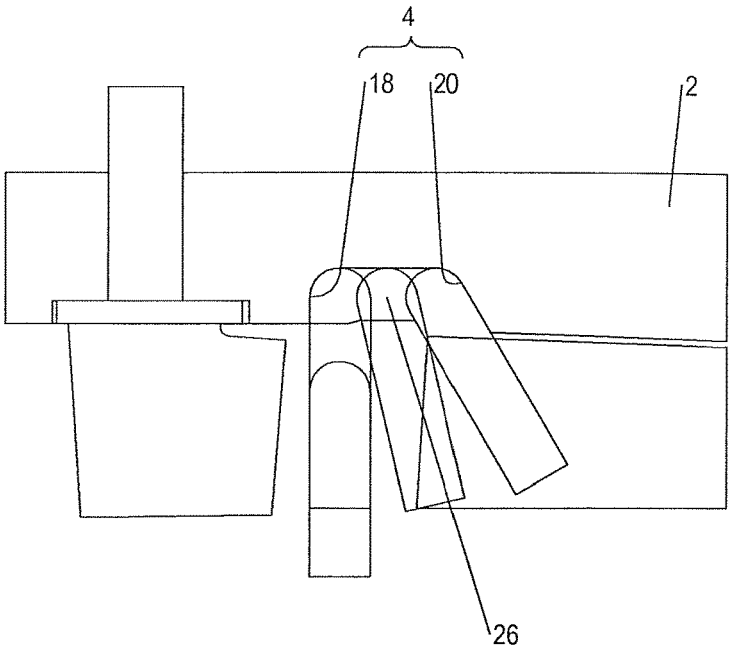
FIGS. 8 and 9 show tool guides with a one-piece turbomachine housing in the region of the circulation structure.

FIG. 8 shows a tool guide for inserting a circulation structure 4 into a one-piece stator housing 2 of a turbomachine. The circulation structure 4 has a front asymmetrical structure region 18 with a plurality of baffle elements 26 and a rear circumferentially symmetrical structure region 20. The circulation structure 4 is inserted into the stator housing 2 directly by means of mechanical machining. The air ducts 28 between the baffle elements 26 are preferably created in a single machining operation as illustrated in FIGS. 2 to 5. Furthermore, the rear structure region 20 may be machined in the stator housing 2 by means of a corresponding milling guide.

Figure 9:
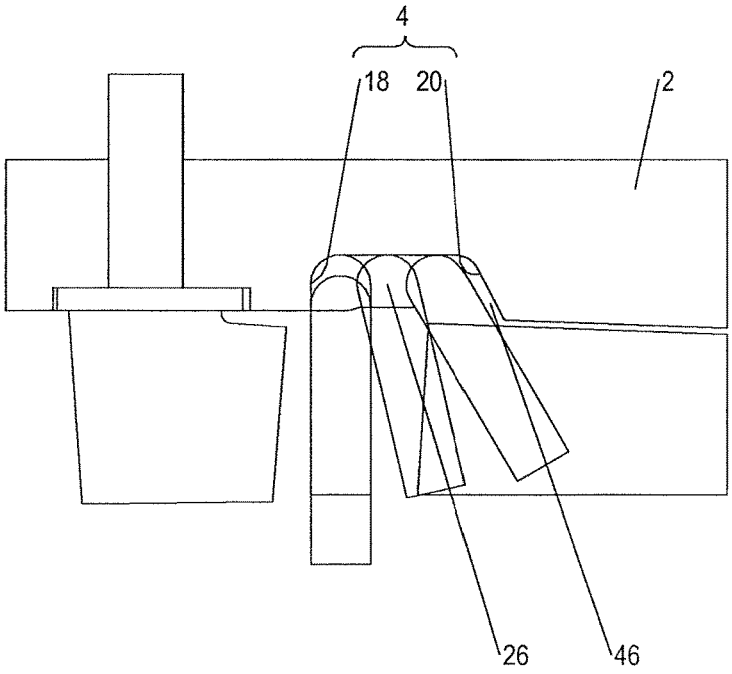

According to the diagram in FIG. 9, the rear structure region 20, as indicated by the gap 46, may also be prepared in a turning operation. The rear structure region 20 may of course also be turned out completely.

A turbomachine is disclosed, having at least one circulation structure, which in turn has an annular space with baffle elements that extends around a main flow path and is open to it, wherein a housing of the turbomachine is divided into a front housing region and a rear housing region to receive the circulation structure in an axial plane of separation, and the circulation structure is divided into a front structure region and a rear structure region in an axial plane of separation; a circulation structure divided into two parts in the axial direction; and a method are also disclosed.

LIST OF REFERENCE NUMERALS

1 flow channel/main flow path
2 stator housing/housing

4 circulation structure
6 guide blade ring
8 row of rotor blades
10 front housing region
12 rear housing region
14 front annular recess
16 rear annular recess
18 front structure region
20 rear structure region
21 annular gap
22 annular space
24 insertion and/or insert element
26 baffle element
28 air duct
30 paneling element
32 abradable lining
34 body section/retaining section
36 retaining ring
38 holding groove
40 milling tool
42 basic contour
44 milling cutter
46 gap
Ts axial plane of separation of the stator housing
Tz axial plane of separation of the circulation structure
$\alpha$, $\alpha_1$, $\alpha_2$ setting angles
h, $h_i$, $h_2$ height
$b_L$ width of air duct
$b_S$, $b_{S1}$, $b_{S2}$ width of baffle element
$r_u$ original transitional radius
$r_r$ reduced transitional radius The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A turbomachine, comprising:

a housing, wherein in a first physical axial plane of separation, the housing is divided into a two-part structure including a front housing region and a rear housing region; and a circulation structure accommodated in the housing, wherein the circulation structure has an annular space, wherein baffle elements are disposed in the annular space, wherein the annular space extends around a main flow path and is open to the main flow path, wherein the circulation structure, in a second physical axial plane of separation, is divided into a two-part structure including a front structure region and a rear structure region, wherein a gap is formed between the front structure region and the rear structure region at the second physical axial plane of separation, and wherein the rear structure region is formed by a front body section of a paneling element which is disposed in the rear housing region.

2. The turbomachine according to claim 1, wherein the first axial plane of separation and the second axial plane of separation are a same axial plane of separation in an assembled state.

3. The turbomachine according to claim 1, wherein the baffle elements are formed in the front structure region and wherein the front structure region is disposed in the front housing region.

4. The turbomachine according to claim 1, wherein the baffle elements are formed in the front housing region.

5. A method for inserting a circulation structure into a housing of a turbomachine, comprising the steps of:

providing a housing of the turbomachine which is divided into a two-part structure including a front housing region and a rear housing region in a first physical axial plane of separation;

inserting a front structure region of the circulation structure into the front housing region of the housing and inserting a rear structure region of the circulation structure into the rear housing region of the housing, wherein the circulation structure is divided into a two-part structure including the front structure region and the rear structure region in a second physical axial plane of separation, wherein a gap is formed between the front structure region and the rear structure region at the second physical axial plane of separation, and wherein the rear structure region is formed by a front body section of a paneling element which is inserted into the rear housing region; and joining the front and the rear housing regions in at the first physical axial plane of separation.

6. The method according to claim 5, further comprising the step of forming air ducts in the front structure region of the circulation structure between baffle elements.

7. The method according to claim 5, wherein the rear structure region of the circulation structure is formed by turning.

8. The method according to claim 5, further comprising the step of forming baffle elements in the circulation structure and wherein transitional radii of the baffle elements are machined after forming the baffle elements.

* * * * *